US005103612A

United States Patent [19]

Wright

[11] Patent Number: 5,103,612

[45] Date of Patent: Apr. 14, 1992

[54] FLEXIBLE TRIM MEMBER

[76] Inventor: Lon C. Wright, 153 Old Orchard Rd., Chalfont, Pa. 18914

[21] Appl. No.: 597,033

[22] Filed: Oct. 15, 1990

[51] Int. Cl.[5] ..... E04F 19/02

[52] U.S. Cl. ..... 52/288; 52/287

[58] Field of Search ..... 52/287, 288, 108, 718, 52/717, 255, 716

[56] References Cited

U.S. PATENT DOCUMENTS 3,099,058 7/1963 Pettingell ..... 52/717.1

4,920,709 5/1990 Garries et al. ..... 52/717.1

*Primary Examiner*—Michael Safavi

*Attorney, Agent, or Firm*—Joseph W. Molasky & Assocs.

[57] ABSTRACT

A flexible trim member or molding for use when installing siding or coping on building structures. The trim member is fabricated of accordian or pleated type construction to allow for placement upon inside corners and edges that are uneven or irregular. The trim member easily accommodates itself to the irregularities to facilitate the placement of the siding or coping that butts against the uneven corners or edges.

8 Claims, 3 Drawing Sheets

FIG. 4
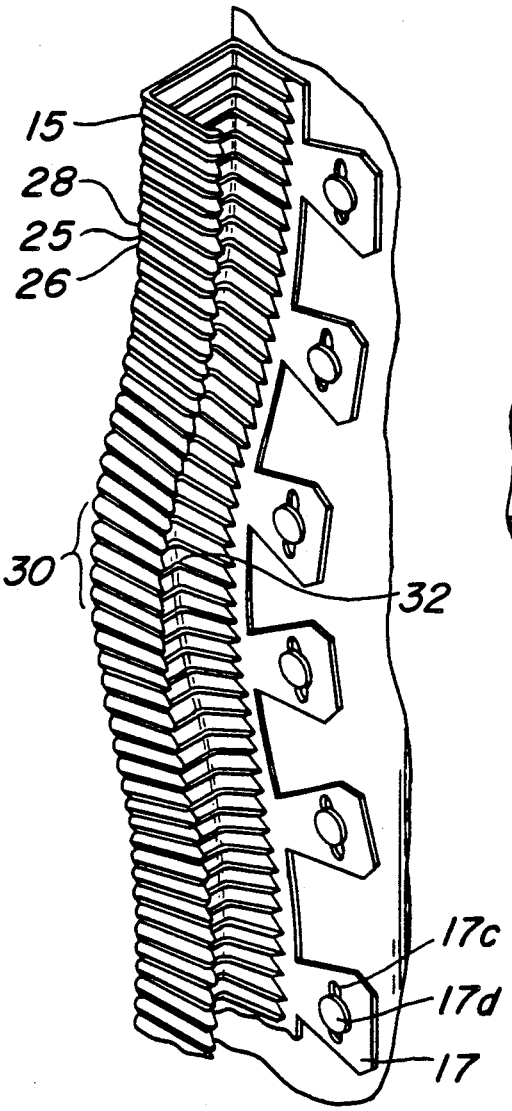
FIG. 5
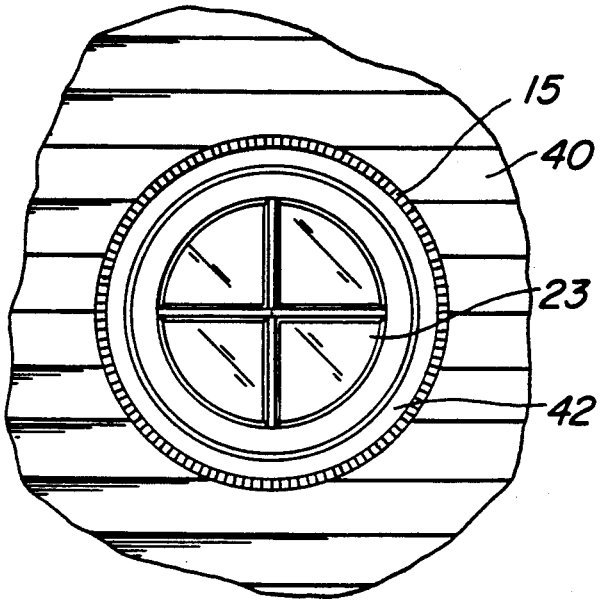
FIG. 7
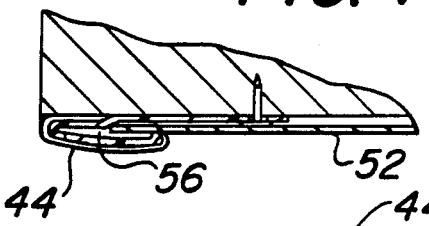
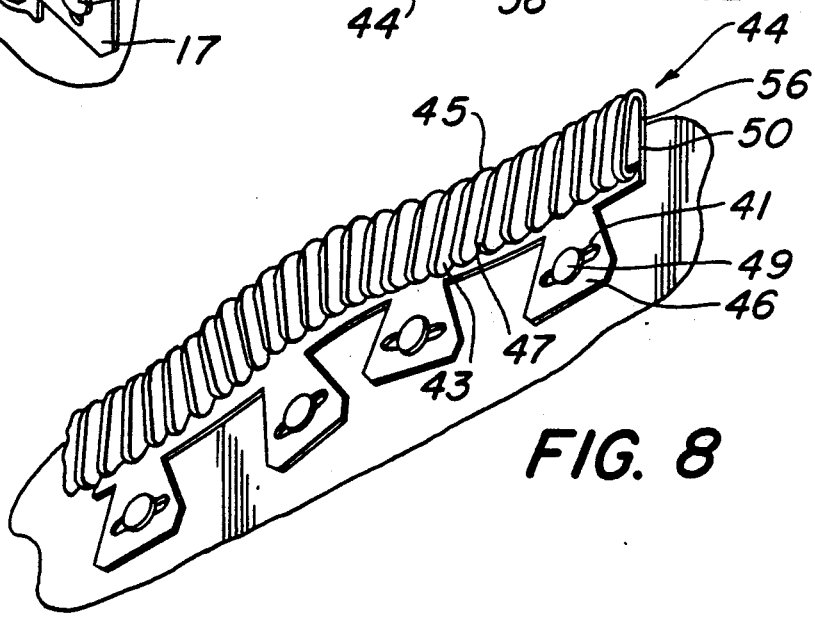
FIG. 8

FLEXIBLE TRIM MEMBER

BACKGROUND OF THE INVENTION

This invention relates in general to trim members and, in particular, to trim members that are useful in inside corners having irregular masonry construction. It is also useful in applying a trim member to round or round topped windows.

In the building trades it is the present-day practice to use rigid J-channels and snap lock trim members to conform the ends of vinyl or aluminum siding to an uneven or irregular surface. Such an uneven surface may result, for example, from an inside corner where one wall having a stone veneer intersects another wall which is covered with parallel side panels. As is understood, the end of the stone veneer is irregular and uneven and therefore it is difficult with the rigid trim members presently available in the art to provide a smooth transition between the veneer and the side panels.

It is also the practice in the art to utilize rigid J-channels and snap lock members in which slits are cut by the siding installer in order to conform to the uneven masonry or irregular corner. This arrangement has not proven to be satisfactory primarily because this work is time consuming which is not conducive to the overall productivity of a worker. The modification of rigid trim in the above applications are found to be time consuming since the sections identified by consecutive slits have to overlap in order to make the trim water tight. The time expended for a rigid trim modification may be as high as one-half hour for installing an eight foot high section and this is deemed to be too inefficient by workers in the construction business.

The present invention has been designed to provide a new and useful flexible trim member for use in uneven corners particularly those in which one side is made of masonry construction and the other side is made of vinyl or aluminum paneling.

This invention has also been designed to provide a new and useful trim member that accommodates itself to regular shapes such as round windows to which parallel siding is made to abut.

This invention has also been designed to improve efficiency and productivity of construction workers in the siding trade.

SUMMARY OF THE INVENTION

The flexible J-channel trim member herein are utilized in construction when vinyl (PVC) or aluminum siding placed upon a wall surface butts up against an uneven masonry wall. The snap lock channel of the invention provides a decorative molding for a regularly shaped opening or curved surface in which, for example, aluminum coping is employed.

The trim member is constructed to include a plurality of circumferential grooves which are separated by unequal length sides. This configuration allows the sides of the trim member to overlap when bending forces are applied so that circumferential folds along an inner radius are produced; at the same time, the grooves opposite the inner radius become unfolded. As a result of this structural arrangement the trim member may be easily crimped in accordian like fashion to the irregularities of a corner or edge when the trim is positioned with nailers.

BRIEF DESCRIPTION OF THE DRAWINGS

FIG. 4 is a front elevational view of the J-channel including the nailers attached to one of its sides.

FIG. 5 is a front view of the J-channel which is utilized with a circular window and siding.

FIG. 7 is a front view of the snap lock member of FIG. 6 being utilized with metal coping.

FIG. 8 is a sectional view taken along line 8—8 of FIG. 7.

DESCRIPTION OF THE PREFERRED EMBODIMENT

Figure 1:
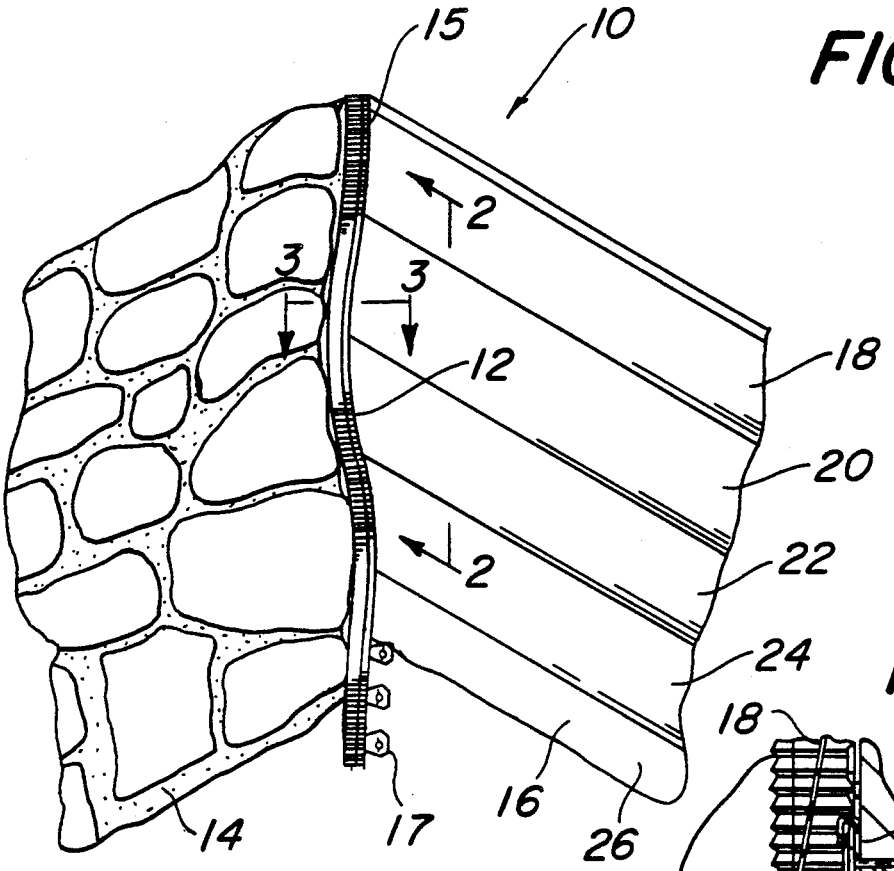
FIG. 1 depicts an inside corner of a building structure where one wall is made of masonry and the adjacent wall is made of vinyl or aluminum paneling.

Referring to the Drawings and to FIG. 1 in particular, there is depicted a two wall building structure 10 that is constructed in such a way as to produce an inside corner 12. The inside corner 12 is formed at an intersection of a masonry wall 14 and a wall 16 covered with a plurality of parallel panels 18, 20, 22, 24 and 26 made of polyvinyl chloride (PVC) or aluminum. The masonry wall 14 may consist of a veneer of cut stone over wooden framing or an actual wall of stone which has an uneven edge surface when constructed by a mason. The side paneling applied to wall 16 is required to be positioned relatively close to the uneven edge of the masonry wall in a manner that provides an attractive transition between the two different surfaces. To accomplish this a flexible transitional member 15 is located in the inside corner 12 for adjusting to the irregularities of the corner 12.

In accordance with the invention the flexible trim member 15 allows the siding panels 18, 20, 22, 24, 26 to be easily butted against the uneven edge surface created by the stone placement in the masonry wall 14. As understood, the stone edges cannot be easily squared without a burdensome labor effort; therefore, the flexible member 15 including a plurality of equally spaced nailers 17 is able with minimum effort to be crimped in accordian-like fashion to the various irregularities of the uneven inside corner 12. The flexible member 15 therefore may be attached with minimum effort therefore saving time and effort. The member 15 is able to receive the siding panels whose ends therefore may be cut with a normal tolerance.

Figure 2:
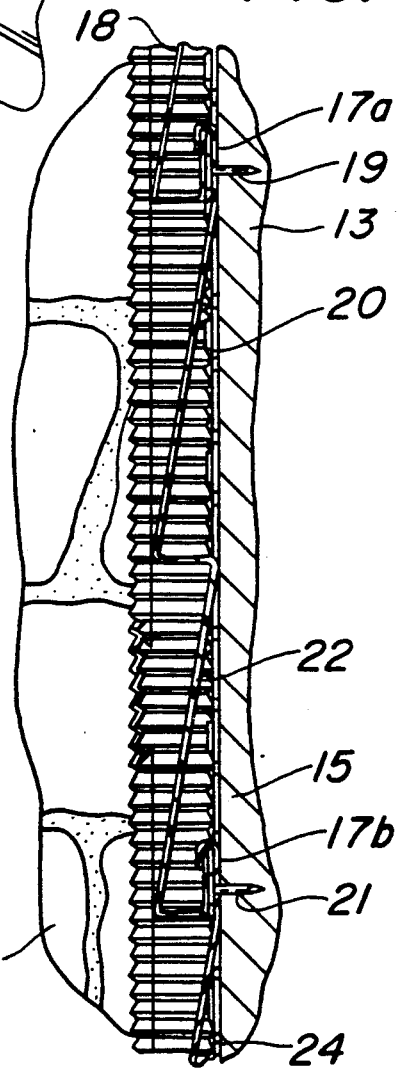
FIG. 2 is a sectional view taken along line 2—2 of FIG. 1 depicting the paneling cross section within the opening of the J-channel.
Figure 3:
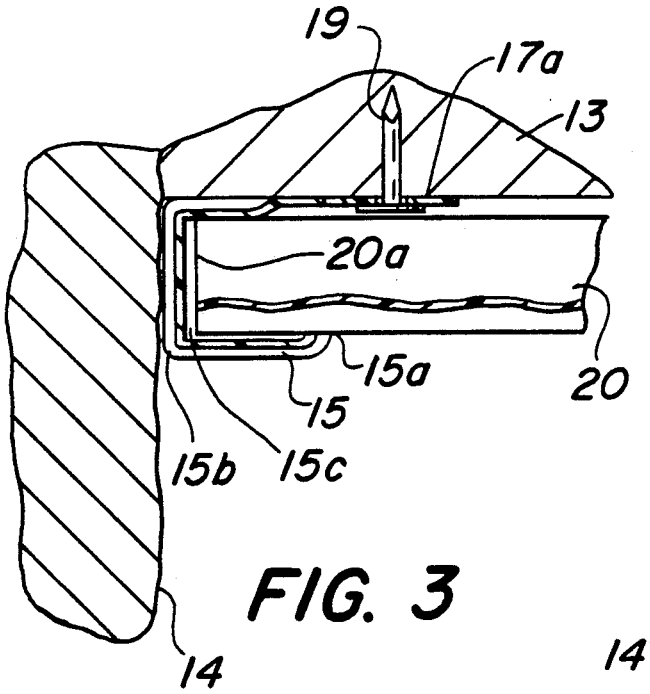
FIG. 3 is a sectional view taken along line 3—3 of FIG. 1 depicting a partial length of the paneling within the J-channel opening.

The trim member 15 may be sectionally viewed by referring to FIGS. 2 and 3. FIG. 2 illustrates the member 15 together with nailers **17*a*, 17*b* positioned upon the inside corner provided by the masonry wall 14 and wooden framing 13. The member 15 is maintained in position by the nailers 17*a*, 17*b* and the nails 19, 21 which are driven through an oblong slot that is provided therein. The nailers are integrally formed with the member 15 which may be viewed with greater clarity in FIG. 3 where a cross sectional view of the member 15 is illustrated. The member 15, which has an appearance of the alphabetic letter J, allows an end 20***a* of the PVC or aluminum panel 20 to be closely positioned against the uneven masonry wall 14 as a result of an opening which allows the paneling to easily slide inwardly in juxtaposition to the uneven wall 14. The J-channel 15 is held in position by the nailer 17*a* through which a nail 19 may be driven into the wooden framing 13. The flexible member 15 substantially aids in the productivity of a worker who is applying the side paneling 18, 20, 22, 24, 26 since it can be rapidly installed while at the same time forming a water tight seal. The depth of the J-channel extends from end 15*a* to bottom 15*b* and may be as small as three-quarters of an inch or as large as one and three quarter inches. A space 15*c* is shown between the bottom 15*b* of channel 15 and the end of the panel 20 to illustrate the tolerance that may be exercised by the installer. The flexibility of member 15 is of great value from a productivity viewpoint since it need not be periodically cut to accommodate itself to the inherent irregularities of the inside corner 12 as was required in the prior art. As understood, in the prior art it is difficult to achieve a water tight seal in view of the numerous slits that have to be made to fit the irregularities.

The flexible J-channel 15 is shown in greater detail in FIG. 4 of the Drawings which is depicted as being formed by a plurality of circumferential grooves 25 which have sides 26, 28 of unequal length. The side 26 is greater in length than side 28 in the present embodiment although the length may be reversed without departing from the spirit of the invention. This structural configuration allows the J-member 15 to be contracted upon one side and expanded at an opposite side of a circumferential groove such as groove 25 when a bending action occurs to accommodate an irregularity. As an example, the flexible J-member 15 bows outwardly along the section 30 which causes a radius to form due to the tendency of this side of the member 15 to unfold and the sides 26, 28 to be displaced from their quiescent position around the grooves 25. At the same time that the installer is causing the section 30 to be formed to fit a certain irregularity in the inside corner of FIG. 1, the formation of a corresponding opposite inside radius 32 is caused by a lengthwise contraction of the smaller and larger sides 26, 28 surrounding the circumferential grooves 25.

The flexibility attribute of member 15 is demonstrated in FIG. 5 where it surrounds a window 23 as a transitional piece between certain parallel siding panels 40 and the window frame 42. In a similar manner to that previously described, the J-channel member is able to accommodate itself to a geometrical configuration, namely, a circumference of frame 42; this is accomplished without any cutting or slitting so that the ends of panels 40 or any portion thereof may be readily cut to fit the round exterior of window 23. The flexibility of the member 15 allows the installer to be easily positioned around the frame 42 and the roughly cut ends and portions of the various panels 40 to be located within the opening provided by the J-channel.

Figure 6:
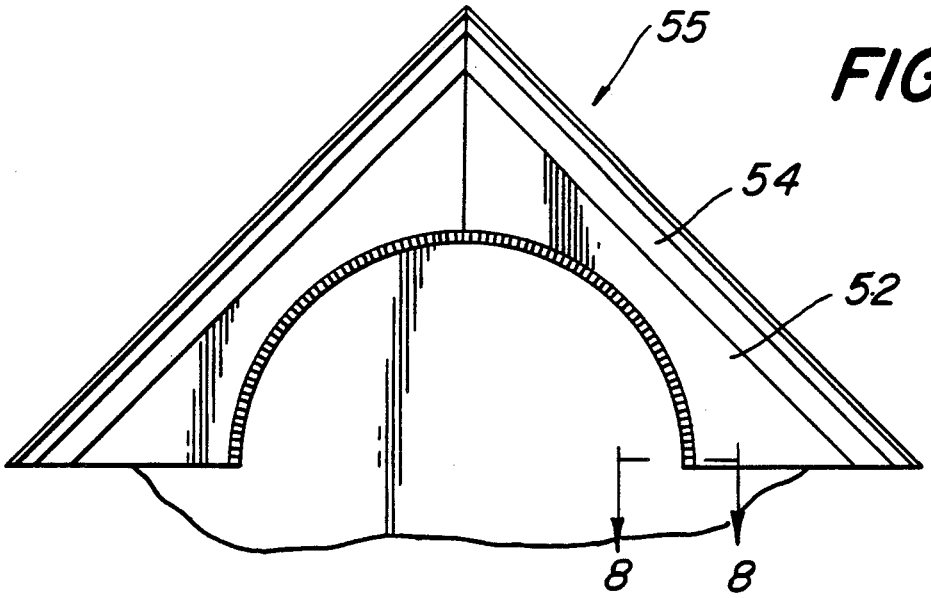
FIG. 6 is a front elevational view of the snap lock trim member of the invention.

In FIG. 6 another embodiment of the invention representing the snap-lock trim member 44 is shown in a front elevational view. The snap-lock member 44 is similarly constructed to the J-channel 15 in that a plurality of circumferential grooves 45 having unequal length sides 43, 47 are provided. Nailers 46 are also included which are integral with the side 50 for use in attaching to a building structure. The nailer 46 includes a slot 41 for expansion purposes on the nail 49. In the embodiment shown the side 43 is larger dimensioned than side 47 which allows the snap-lock device 44 to assume a serpentine or geometrical configuration within its mechanical boundries in the manner previously discussed with respect to the J-channel 15.

The snap-lock trim piece 44, which is approximately three-quarters of an inch wide, allows a wide tolerance of a decorative metal coping 52 applied to the cupola-like structure 55 which attached to the roof structure of a building; it should be noted that the trim member 54 applied to the roof-line of the cupola 55 is separate and distinct from the coping 52. The snap-lock member 44 allows the semi-circular metal coping 52 that is normally made of aluminum to be cut with a relatively wide tolerance before it is inserted within the provided opening 56. This rough cutting of the coping is significant in view of the productivity that is gained when the installer does not have to cut the coping 52 with an accurate measure; in addition, productivity is gained because of the flexibility of the snap piece 44 which may be readily flexed in the shape of the semi-circle of FIG. 7. This allows the snap lock piece 44 to cover the rough edge of the coping so that an attractive appearance is produced.

The cross-sectional view of FIG. 8 taken through line 8—8 of FIG. 7 illustrates how the roughly cut coping 52 may be inserted within the opening 45 of the snap piece 44. Since the member 44 is approximately three-quarters of an inch wide it is apparent that a wide tolerance is allowed in forming the semi-circular shape of the coping 52.

Figure 9:
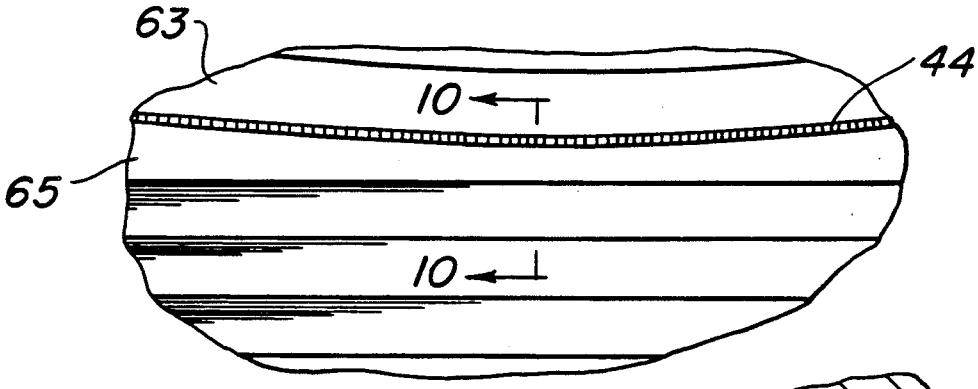
FIG. 9 is a front view of a utilization of the snap lock trim member with respect to a drooping soffit.
Figure 10:
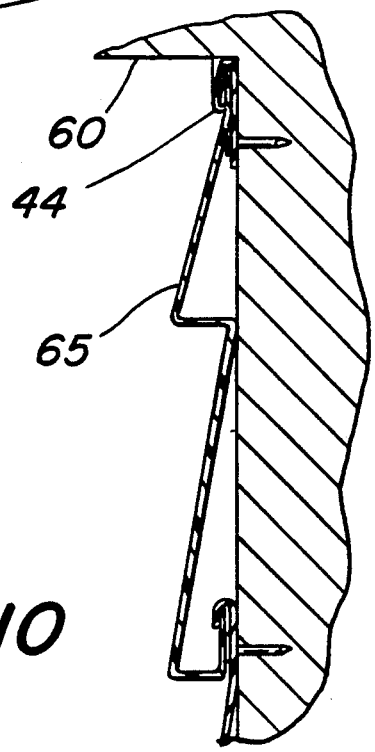
FIG. 10 is a sectional view taken along line 10—10 of FIG. 9 illustrating the side paneling transitionally joined to the snap lock trim.

The flexible snap-lock piece 44 also finds application in the showing of FIG. 9 where a drooping soffit 60 may be accommodated in an older home when new siding panels 65 are being installed. The trim member 44 as a result of its flexibility is able to adjust to the sagging of the center portion of the soffit 60 and to roughly modify the panel 65 to fit within the opening provided so that an attractive appearance is presented in combination with the fascia board 63. This may be seen in FIG. 10 wherein the cross-sectional view taken through line 10—10 of FIG. 9 illustrates how the top edge of side panel 65 is modified to fit within the snap-lock member 44.

In summary, the unique structure of the flexible J-channel and snap-lock members have been described to demonstrate their utility with respect to various applications. Their usefulness is of importance to siding installers in view of the speed improvement that is obtained in hanging the J-channel or snap-lock members where uneven inside corners or geometric shapes are encountered.

This invention has been described by reference to precise embodiments but it will be appreciated by those skilled in the art that this invention is subject to various modifications and to the extent that those modifications would be obvious to one of ordinary skill they are considered as being within the scope of the appended claims.

What is claimed is:

1. A combination comprising:

(a.) a watertight, flexible and continuous member for attachment to a building structure and having a plurality of equally spaced circumferential grooves, (b.) each said groove having a base and first and second peaks;

(c.) side surfaces respectively joining said base with said first and second peaks wherein one said surface has a length dimension that is shorter than a second said surface;

(d.) means integrally joined to said flexible member for permitting attachment to said building structure;

(e.) means formed in said member for receiving the terminals of parallel side panels place upon said structure; and (f.) said flexible member providing a decorative transition for a plurality of said side panels abutting against uneven corners and edges of said structure.

2. The combination in accordance with claim 1 wherein said flexible member comprises a substantially J-shaped cross section for receiving said side panels.

3. The combination in accordance with claim 1 wherein said integrally joined means comprises periodically placed extension emanating from a side of said member for receiving fasteners that attach to the building structure.

4. The combination in accordance with claim 3 wherein said extension include oblong slots for receiving said fastners that pierce said building structure.

5. The combination in accordance with claim 1 wherein said flexible member comprises a substantially flat shaped configuration, said configuration including a snap lock entranceway for allowing the insertion of said side panel terminals.

6. The combination in accordance with claim 1 wherein said flexible member is located within an inside corner of a structure wherein one wall of said structure is made of masonry having an uneven edge and the adjacent wall is covered with vinyl or, alternatively, metal siding.

7. A combination comprising:

(a.) a watertight, flexible and continuous member for attachment to a building structure and having a plurality of equally spaced circumferential grooves, (b.) each said groove having a base and first and second peaks;

(c.) side surfaces respectively joining said base with said first and second peaks wherein one said surface has a length dimension that is shorter than a second said surface;

(d.) said grooves allowing said member to be flexed in various direction such that one portion of a flexed bend is in tension and an opposite portion is in compression;

(e.) periodically positioned attachment means integrally formed upon said flexible means for connection to said building structure;

(f.) said flexible member having a partially opened cross section for allowing side paneling to be inserted therein with a snap-lock action; and (g.) whereby said flexible member provides a transitional connection between a geometrical surface and said side paneling.

8. A J-channel member for providing a transitional device for use with side paneling around openings in a building structure in which doors, louvers or similar such inserts are installed, the improvement comprising:

(a.) a watertight, flexible and continuous J-channel member having a plurality of equally spaced grooves;

(b.) each said groove having a base and first and second peaks;

(c.) side surfaces respectively joining said base with said first and second peaks wherein one side surface has a length dimension that is shorter than a second said surface;

(d.) means attached to said member for permitting attachment to said building structure; and (e.) whereby said continuous member is placed in a location on said structure whereing the adjacent side surfaces to a groove contract and expand to allow for ease of placement against an irregular surface.

* * * * *